United States Patent [19]

Nobileau

[11] Patent Number: 4,909,546

[45] Date of Patent: Mar. 20, 1990

[54] TENSION LOCK MULTIBOWL WELLHEAD

[75] Inventor: Philippe C. Nobileau, Paris, France

[73] Assignee: Vetco Gray Inc., Houston, Tex.

[21] Appl. No.: 259,229

[22] Filed: Oct. 17, 1988

[30] Foreign Application Priority Data

Oct. 27, 1987 [FR] France ..... 87 14862

[51] Int. Cl.[4] ..... E21B 33/04; F16L 21/00

[52] U.S. Cl. ..... 285/141; 285/3; 285/18; 285/323; 285/143; 166/206; 166/217

[58] Field of Search ..... 166/85, 115, 77.5, 195, 166/217, 206, 208; 175/423; 285/138, 140–145, 3, 18, 307, 322, 323, 394, 358

[56] References Cited

U.S. PATENT DOCUMENTS

| | | | |
|---|---|---|---|
| 2,737,248 | 3/1956 | Baker | 285/141 |
| 2,849,245 | 8/1958 | Baker | 285/141 |
| 4,390,186 | 6/1983 | McGee et al. | 277/236 |
| 4,469,172 | 9/1984 | Clark | 166/115 |
| 4,607,865 | 8/1986 | Hughes | 285/141 |
| 4,641,708 | 2/1987 | Wightman | 166/208 |
| 4,678,209 | 7/1987 | Guice | 285/144 |
| 4,773,477 | 9/1988 | Putch | 285/141 |

FOREIGN PATENT DOCUMENTS

| | | |
|---|---|---|
| 1171201 | 11/1969 | United Kingdom . |
| 2109030 | 5/1983 | United Kingdom . |

*Primary Examiner*—Bruce M. Kisliuk

*Attorney, Agent, or Firm*—James E. Bradley

[57] ABSTRACT

A mechanism for locking a casing in a stationary support has an intermediate element which can move elastically in a receptacle of the support. The receptacle has upper and lower conical flanks. Conical inner grooving of the intermediate element has conical flanks of an angle at the apex greater than the angle at the apex of the upper flanks of the receptacle and less than the angle at the apex of the corner flank. The resultants of the forces to which the intermediate element is subjected has a radial component. When pulled upward, the radial component is outward. Under a downward force, the radial component is inward.

6 Claims, 3 Drawing Sheets

7b
4a
2a
13
3
F1
6a
6b
1
2
9
R1
1a
8
F1
11
12
11a
14
10
5c
A
7a
4b
5b
5

3
F4

2
9
13
1
R2
1a
B
F3
10

TENSION LOCK MULTIBOWL WELLHEAD

BACKGROUND OF THE INVENTION

1. Field of the Invention:

The present invention relates to a device for ensuring simply and accurately the tensioning of a cylindrical body, such as a rod or a casing, which can elongate elastically when it is made to undergo a tensile force. Although the use described below relates essentially to the tensioning of a casing for an oil well, the invention can be used for tensioning and maintaining this tension in any body capable of undergoing elastic elongation.

2. Description of the Prior Art:

The suspension of the casings on the wellhead in an oil-well installation is usually obtained by means of a wedge mechanism which, bearing on an inner conical surface of the wellhead, highly compresses the outside of the casing in order to obtain the suspension of the latter. In most cases, in order to install this wedge mechanism, it is necessary to remove the blow-out preventer block and use a wellhead with stacked receptacles, each of them being associated with each casing, in such a way as to make it easier to cut the casing above the wedge mechanism. After the casing has been cut and chamfered, a sealing element is slipped between the bore in the receptacle of the wellhead and the casing in order to isolate the annular space present between the casing and the wellhead.

The development of underwater wellheads has given rise to integral wellheads possessing a suspension collar for the casing. In this case, the casing is connected by screwing to a collar which has a substantially radial bearing shoulder, thus avoiding the need to use a wedge mechanism and eliminating the annular compression stresses generated in the casing by this wedge mechanism. An annular sealing element can then be installed remotely between the suspension collar. This arrangement makes it possible to avoid disconnecting the blow-out preventer, and the latter can then ensure the protection of the operations of suspension, cementing and sealing the casing. Because the casing does not have to be cut, receptacles for each casing dimension can be connected in one piece to form an integral wellhead.

This arrangement with a suspension collar and an integral wellhead is not suitable when tension must be introduced into the casing after cementation. It is then necessary to return to the mechanism with locking wedges.

SUMMARY OF THE INVENTION

The present invention is intended to avoid the need to resort to the wedge mechanism, by providing a casing suspension device capable of adjustment and of locking of the tension introduced into the casing. This device greatly reduces the circular compression stresses in the casing and avoids the need to cut the latter. For this purpose, the subject of the invention is, therefore, a device for adjusting and locking the tension of a cylindrical body in relation to a stationary outer support. The device consists of an intermediate locking element distributed around the cylindrical body. The intermediate element moves radially in corresponding receptacles of the support. The intermediate element comprises a surface facing the cylindrical body and equipped with grooves of triangular profile interacting with similar grooves made circumferentially on the outer surface of the cylindrical body. The intermediate element has a surface facing the bottom of the receptacle and comprising at least two inverted conical bearing surfaces capable of bearing on bearing surfaces made in the receptacle to correspond to them and forming the walls of the latter. The intermediate element is subjected to an elastic restoring force tending to maintain it in a position in which its inner grooves interpenetrate the grooves of the cylindrical body. The angle relative to a longitudinal axis of each of the downward-facing faces of the inner grooving of the intermediate element is less than the angle of the upward-facing outer conical bearing surface of the intermediate element. The angle of the other faces of the grooving is greater than the angle of the other conical bearing surface. Each of the above mentioned angle differences is at least equal to the sum of the arc tangents of the coefficients of friction of the intermediate element on the cylindrical body and on the outer support.

Thus, the above mentioned relative inclinations are such that the resultants of the forces to which the intermediate element is subjected have a radial component directed outward when the cylindrical body is actuated axially in the direction of its elongation, and directed towards the axis when the cylindrical body is subjected to the installed axial tension prestressing force.

In a preferred embodiment, the angle of each face of the inner grooving is equal to 45 degrees, while the angle of the first conical bearing surface is equal to 70 degrees and the angle of the second conical bearing surface is equal to 30 degrees.

In the preferred version of this invention, the intermediate element is an elastic split ring of which the mean diameter of the inner grooving corresponds to the mean diameter of the outer grooving of the cylindrical body. In this case, the depth of the above mentioned grooves is of the order of the possible elastic increase in the radius of the split ring. In an alternate embodiment, the intermediate element comprises a plurality of dogs and corresponding elastic restoring members.

An important use of the device according to the invention involves the use of a suspension head for the tensioning of an oil-well casing, possessing a stack of suspension collars. Thus, the wellhead forms the said outer support, and the cylindrical body is formed by the stack of the suspension collars of the casing which are grooved on the outside and the last of which has an upper flange. The split ring is retained under the upper flange by means of a fastening breakable under the effect of a specific force. The ring is located opposite an annular receptacle made on the said collar so as to be capable of contracting during its introduction into that part of the bore of the wellhead located above the receptacle made in the wellhead.

Advantageously, the annular receptacle made in the upper suspension collar is divided by means of an inner circular partition perpendicular to the axis of the casing. The partition, together with a lower edge of the receptacle, each have a cylindrical bearing surface of a diameter equal to that measured at the bottom of the grooves, where those made in the suspension collar are concerned, and to that measured at the top of the grooves, where those carried by the split ring when the latter is in its position of rest are concerned.

The suspension head according to the invention also possesses a second annular receptacle made on a lower suspension collar. In the event that the casing is raised, the split ring can once again contract radially and thus come away from the receptacle of the wellhead and rise together with the casing in the bore of the wellhead.

Finally, the split ring has a double pair of inverted conical supports. The receptacle of the ring in the wellhead likewise has a corresponding double pair of supports. That part of the bore of the wellhead located above this receptacle has grooves for the installation of a metal sealing joint above the split ring.

The invention will be understood better from the description given below by way of purely indicative and non-limiting example, which will make it possible to ascertain its advantages and secondary characteristics.

BRIEF DESCRIPTION OF THE DRAWINGS

Reference will be made to the accompanying drawings in which.

DESCRIPTION OF THE PREFERRED EMBODIMENT

Figure 1A:
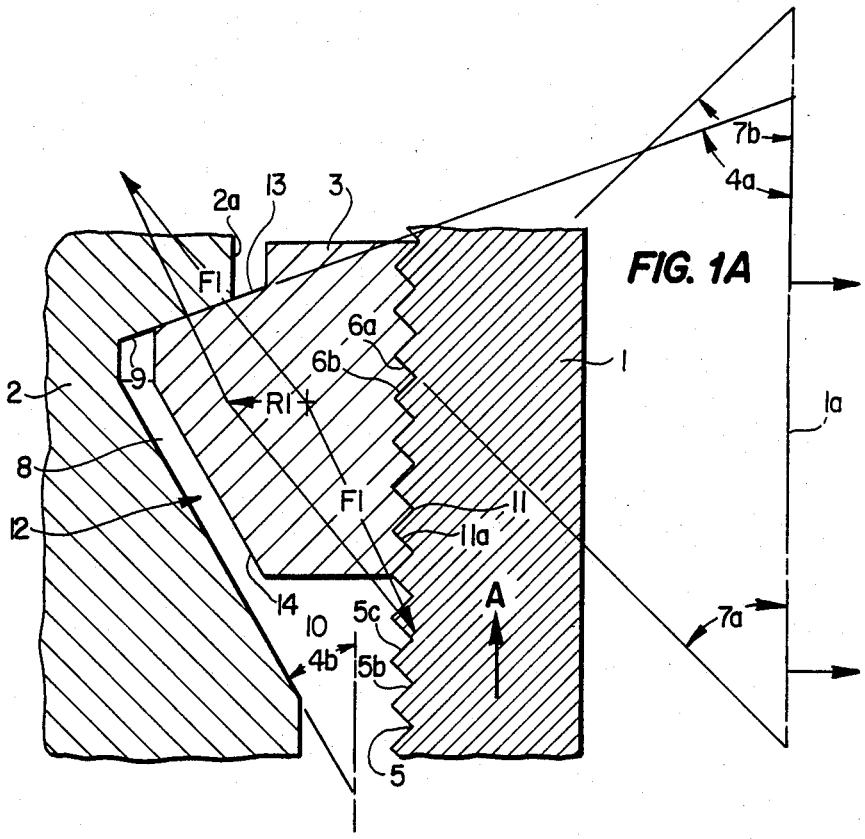
FIGS. 1A and 1B are diagrams illustrating the essential means of the invention.
Figure 1B:
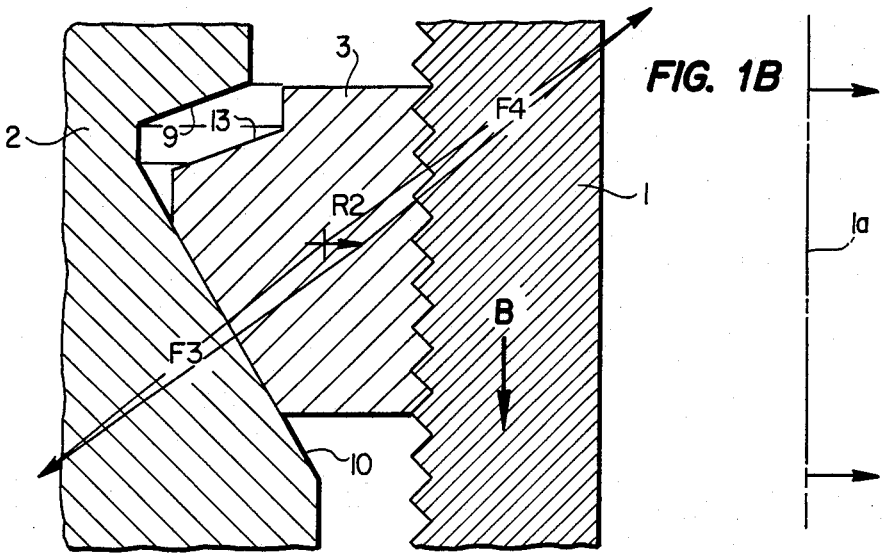

FIGS. 1A and 1B show, in an axial half-section, a cylindrical body 1 of longitudinal axis 1*a* accommodated in a bore 2*a* of a stationary support 2 coaxial relative to the body 1 and retained in this support by means of an intermediate piece 3.

The cylindrical body 1 has peripheral grooves 5, each of which has a conical upper flank 6*a* and a conical lower flank 6*b*, and therefore are of triangular profile. Each flank 6*a*, 6*b* is located at an angle 7*a*, 7*b*, respectively, of 45 degrees relative to longitudinal axis 1*a*.

Support 2 is equipped with an annular receptacle 8, delimited by a downward facing conical upper surface 9 and an upward facing conical lower surface 10. The angle 4*a* of the downward-facing surface 9 is 70 degrees, and the angle 4*b* of the upward-facing surface 10 is 30 degrees, measured relative to longitudinal axis 1*a*.

The intermediate element 3 is delimited by an inner cylindrical surface having grooves 11, forming a grooving capable of interacting with the grooves 5 of the body 1. Each groove has a flank 11*a*. Intermediate element 3 has an outer surface 12 comprising two conical bearing surfaces 13 and 14, the profile of which is identical to the profile of the receptacle 8.

The radial thickness of the intermediate element 3 and the depth of the receptacle 8 are such that, when the element 3 is shifted radially inside the receptacle 8, the grooving 11 is no longer in engagement with the grooves 5 of the piece 1. Furthermore, these dimensions are such that, when the grooves 11 are in engagement with the grooves 5, the piece 3 cannot escape from the receptacle 8 axially.

The intermediate piece 3 can comprise a split ring arranged in the receptacle 8 with a radial play allowing an increase in its outer radius corresponding to the depth of the grooves 5, 11. The mean diameter of the grooves 11 of the ring is, in the free state, equal to the mean diameter of the grooves 5 of the body 1. It will therefore be appreciated that the variations in diameter of the ring 3 occur counter to its elasticity which tends to return it to its position of rest.

As an alternative to a split ring, the body 3 can comprise a plurality of radial dogs (not shown) arranged in receptacles likewise distributed in the same plane of the support and subjected to the action of radial elastic members for the restoring of the dogs to their position of rest corresponding to the coincidence of the mean diameter of their grooving with that of the grooving of the cylindrical body 1. It will be seen, in this respect, that in the alternative embodiment of the intermediate piece 3 in the form of dogs, the body 1 can be of polygonal cross-section, the grooved inner surface of each of the dogs being substantially plane and corresponding to the sides of the polygon of the cross-section of the body 1.

Returning to FIGS. 1A and 1B, it can be seen that, when a pull is exerted axially on the central body 1 in the direction A, the support 2 being assumed to be stationary, a set of forces is generated on the piece 3 designated by the arrow F1. The direction of this force is between the direction A and the perpendicular to the face 6*b* of the grooves 5 of the central body 1, somewhat in the vicinity of this perpendicular, because of the friction existing between two central body 1 and intermediate piece 3 (of the order of 0.1 for lubricated metal surfaces).

The reaction of the support 2 on the piece 3 results in a set of forces symbolized at F2, the direction of which is between the perpendicular to the surfaces 9, 13, and the axial direction, and somewhat nearer to this perpendicular because of the friction between these surfaces. The force F1 is directed upwards, while the force F2 is directed downwards. Because of the values of the slopes of the faces 6*b* and 9, 13, and a coefficient of friction assumed to be equal to 0.1 on each of the contacting surfaces (corresponding to a difference in the forces F1 and F2 in relation to the perpendiculars to the faces on which they are exerted of the order of 5 ½ degrees), the direction of the forces F1 and F2 form an angle of approximately 14 to 15 degrees between them. Moreover, since it is the force F1 which is the most inclined relative to the axial direction, the resultant of these forces is a radial force R1 directed away from the axis 1*a*. The element 3 is therefore subjected to a force which tends to open it, where a split ring is concerned, or to cause it to penetrate inside its receptacle against the restoring member, where a dog is concerned. The element 3 can therefore move aside in order to allow the central body 1 to rise.

Conversely, as shown in FIG. 1B, if the element 1 is subjected to a force B directed downwards, corresponding to the installed tension in this element or to its weight, the piece 3 undergoes forces represented by F3, F4. The force F3 is directed downwards and outwards and is inclined at approximately 40 degrees relative to the axis 1*a* (in view of the numerical values of the angles of the coefficients of friction mentioned above). The F4 force is a force directed inwards and upwards and is inclined at an angle of approximately 65 degrees relative to the axis 1*a*, for the same reasons regarding numerical values. The outcome of this is that the resultant R2 of these forces is horizontal and directed towards the axis 1*a*, therefore tending to grip the body 1 and thus preventing the latter from descending.

It will be seen that the intensity of the said horizontal resultants R1 directed outwards or R2 directed towards the axis is relatively low, especially with regard to that R2 directed towards the axis (as shown in FIG. 1B), although added to this is the elastic reaction of the ring or of the restoring member for the dog 3. The circular compression stress generated as a result of R2 is therefore reduced.

The numerical values given in the above example constitute a preferred embodiment of the invention, but the latter can encompass other values which will depend, in particular, on the coefficients of friction or of slip and therefore on the materials in contact, as well as on the mechanical characteristics required for the coupling. It will be seen, for example, that the number of successive axially adjacent grooves and the number of receptacles in the support will be a function of the forces to be absorbed and of the characteristics of shearing resistance of the materials used.

FIGS. 2 to 7 illustrate a use of the device according to the invention, described diagrammatically in FIGS. 1A and 1B, for the suspension of a casing in an oil wellhead. The casing 21 is equipped in a known way with a stack of suspension collars 22*a*, 22*b*, 22*c*, 22*d* screwed into one another and equipped on the outside with grooves 5, as described with reference to the preceding Figures. The tool 23 for installing the casing is fixed to the upper suspension collar 22*d* for installing the casing in the bore 24*a* of the wellhead 24. The upper collar 22*d* for installing the suspension has a receptacle 25 divided into two parts 25*a*, 25*b* by means of an annular partition 26. It also has, above this receptacle 25, a flange 27 equipped with substantially radially slotted orifices 27*a*, through which is fastened a shearing screw 28 capable of being broken beyond a specific tensile force. The screw 28 is screwed into a split ring 29, the inner surface of which has grooves 11. The ring 29 has a receptacle 30 for the partition 26. The ring 29 has an outer surface of which has two inverted conical bearing surfaces 13*a*, 14*a* and 13*b*, 14*b* for interacting with conical bearing surfaces 9*a*, 10*a* and 9*b*, 10*b* of an annular receptacle made in the wellhead 24.

Figure 2:
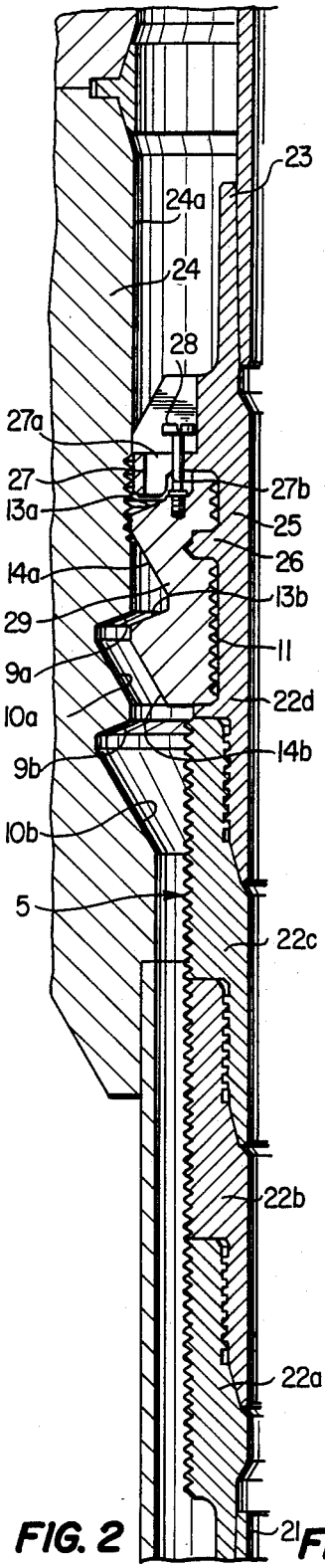
FIGS. 2 to 6 illustrate, in views in axial section, the different sequences for installing the device according to the invention used for an oil wellhead.
Figure 3:
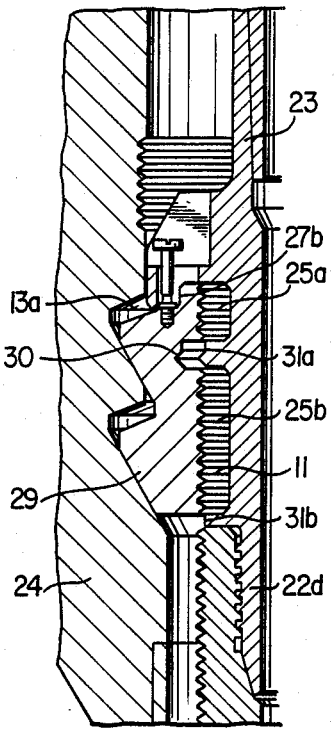

In FIG. 2, the ring 29 is illustrated contracted into the receptacle 25 of the suspension collar 22*d* as a result of the containing effect of the walls of the bore 24*a*. The casing 21 is shown being lowered inside the wellhead 24. When the ring 29 comes opposite the receptacle defined by the conical surfaces 9*a*, 9*b*; 10*a*, 10*b* of the wellhead 24, it seats itself partially in this receptacle under the effect of its own elasticity. The ring 29 reaches its "free state" position and is maintained centered on the axis of the assembly by means of an inner bearing surface 27*b* of the flange 27, which interacts with an upper cylindrical part of the ring (as shown in FIG. 3).

Figure 4:
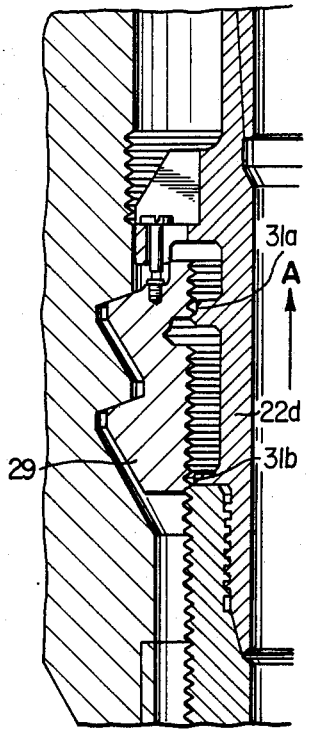

FIG. 4 illustrates the phase in which a pull is exerted on the upper collar 22*d* by means of the tool 23 in the direction A in order to shear the screws 28. Since the end of the partition 26 and the lower end of the receptacle 25 have a cylindrical bearing surface 31*a*, 31*b*, the diameter of which is equal to the diameter at the top of the grooves 11 of the ring 29 in its position of rest, the positioning of the bearing surfaces 31*a* and 31*b* in front of the grooves 11 prevents the ring 29 from contracting once again as a result of the cam effect which the conical bearing surfaces 9*a* and 9*b* could exert on it.

Figure 5:
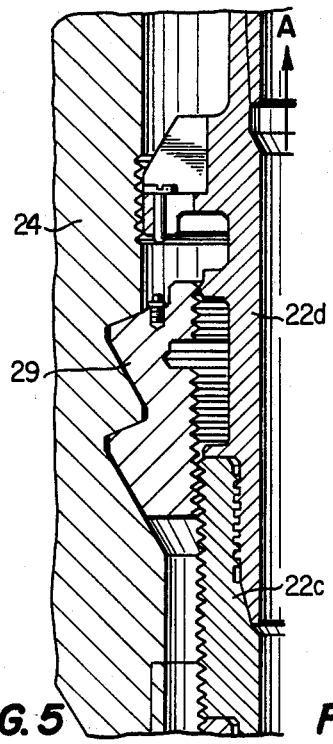
Figure 6:
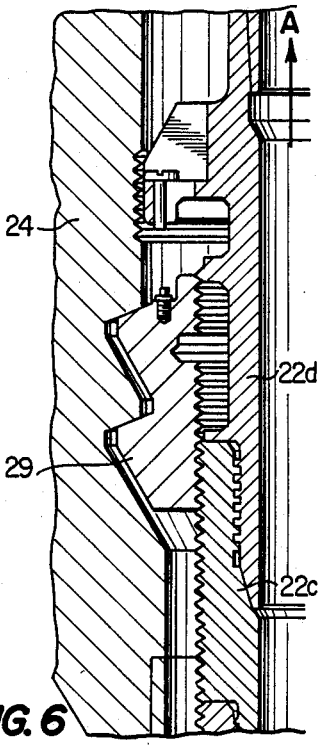

If the upward pull exerted on the casing is continued, forces of the type described with reference to FIG. 1A are generated, thus allowing the casing to rise along the ring 29, the screw 28 having been severed beyond a specific tensile force. This sequence is illustrated in FIGS. 5 and 6, FIG. 5 showing the position of the ring 29 when the tops of the grooves 5, 11 are opposite one another. FIG. 6 shows the position of the ring 29 when the latter is in its position of rest, that is to say interpenetrating the grooves 5 of the suspension collars 22. The inner grooves 11 on ring 29 ratchet past the grooves 5 on suspension collar 22*c*. This operation is continued until the entire axial length of the ring 29 has been placed opposite the grooves 5 of the stack of suspension collars.

Figure 7:
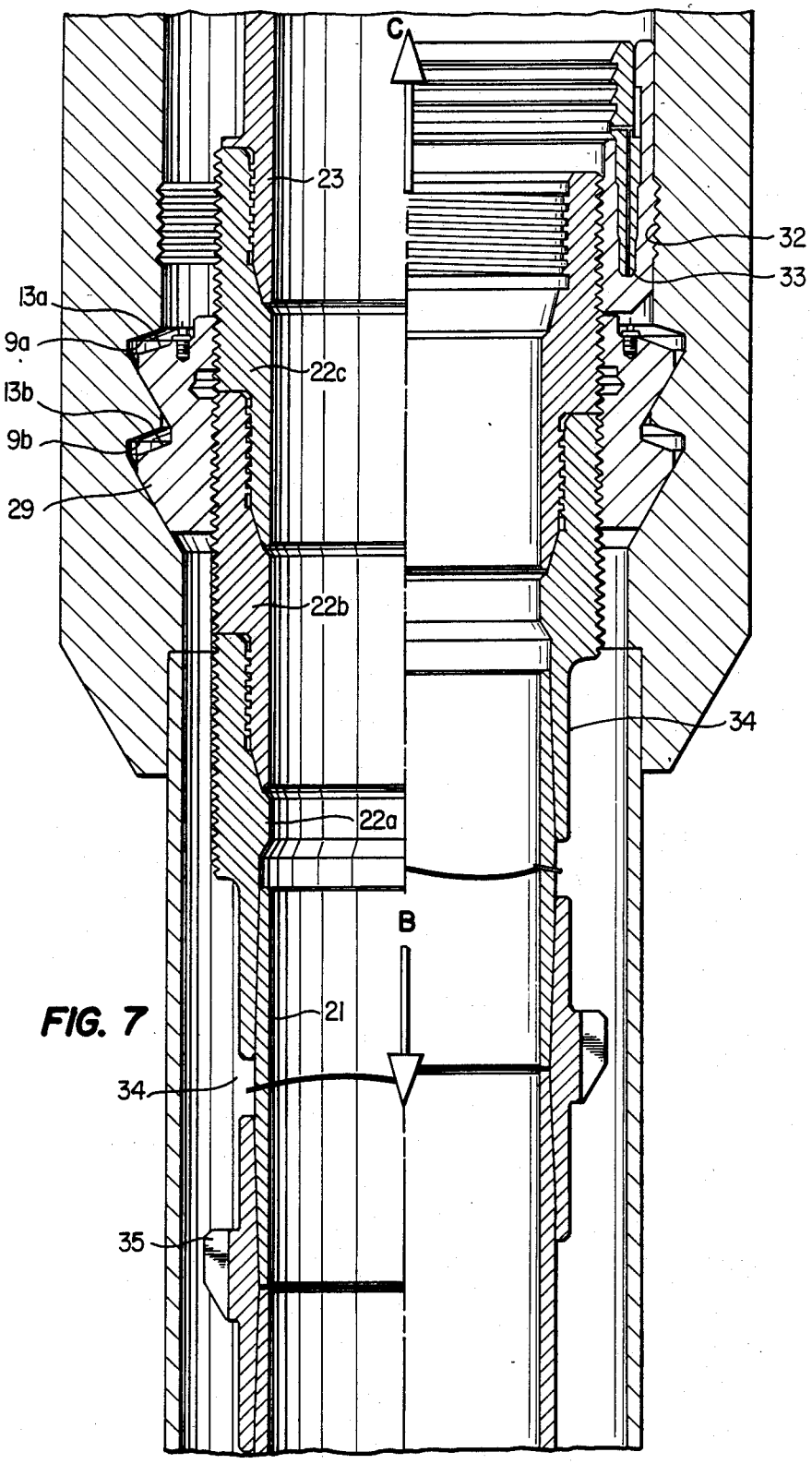
FIG. 7 illustrates, in a view in axial section, on the left a wellhead supporting a casing during the cementation of the latter and on the right a wellhead supporting the casing tensioned after cementation and equipped with a sealing joint.

In the left-hand part of FIG. 7, the casing is shown in its position in which cementation begins. The casing is suspended by means of the ring 29 which retains it against the effect of gravity, as explained with reference to FIG 1B.

If it is necessary to raise the casing in the wellhead at this stage for any reason, a pull is exerted on the casing according to the arrow C, so that the ring 29 comes opposite a lower receptacle 34 made in or under the lower suspension collar 22*a*. A continuation of the pull on the casing in the direction C causes a contraction of the ring 29 into the receptacle 34 as a result of the play of the surfaces 9*a*, 9*b* on the surfaces 13*a*, 13*b* of this ring and the driving of the ring by the shoulder 35 provided at the base of the suspension collars. The ring 29 can then be raised along the bore 24*a* in the wellhead 24.

After cementation, a tensioning of the casing is carried out, and when the value (arrow B) for the desired stress is reached, the ring 29 is in a position similar to that illustrated in FIG. 1B for the intermediate element 3, and the casing is maintained in this position, as illustrated in the right-hand part of FIG. 7. It will be seen that the upper suspension collar 22*d* has been removed, and a metal sealing joint 33 known per se has been installed between the auxiliary grooving 32 made in the bore of the wellhead.

The invention is used in an especially useful way in the sector of oil drilling. The suspension device allows for adjustment and locks tension introduced into the casing. The device greatly reduces circular compression stresses in the casing and avoids the need to cut the latter.

While the invention has been described in only one of its forms, it should be apparent to those skilled in the art that it is not so limited, but is susceptible to various changes and modifications without departing from the scope of the invention.

I claim:

1. A device for supporting a cylindrical body in a stationary tubular outer support, the cylindrical body having a longitudinal axis, the device comprising in combination:

at least one recess located in the outer support, having a conical downward facing bearing surface and a conical upward facing bearing surface;

a plurality of circumferential grooves located on the exterior of the cylindrical body, each of the grooves on the cylindrical body being triangular in longitudinal cross-section;

an intermediate element carried by the cylindrical body, the intermediate element having an inner side containing a plurality of inner grooves having the same configuration in longitudinal cross-section as the grooves of the cylindrical body and for interacting with the grooves of the cylindrical body, each of the inner grooves having an upward facing flank and a downward facing flank;

the intermediate element having an outer side having conical upward facing and downward facing bearing surfaces capable of bearing on the downward facing and upward facing bearing surfaces of the outer support, respectively, the upward facing and downward facing bearing surfaces of the intermediate element being located at angles relative to said longitudinal axis;

means for elastically urging the intermediate element to a position in which the inner grooves engage the grooves of the cylindrical body;

the downward facing flanks of the inner grooves being located at an angle relative to said longitudinal axis that is less than the angle, relative to said longitudinal axis, of the upward facing bearing surface of the intermediate element; and the upward facing flanks of the inner grooves being located at an angle relative to said longitudinal axis that is greater than the angle, relative to said longitudinal axis, of the downward facing bearing surface of the intermediate element, so that when the cylindrical body is subjected to an upward force, a radial component of a resultant of said force is directed outward from said longitudinal axis, and when the cylindrical body is subjected to a downward force, a radial component of a resultant of said force is directed inward toward said longitudinal axis.

2. A device for supporting a cylindrical body in a stationary tubular outer support, the cylindrical body having a longitudinal axis, the device comprising in combination:

at least one recess located in the outer support, having a conical downward facing bearing surface and a conical upward facing bearing surface;

a plurality of circumferential grooves located on the exterior of the cylindrical body, each of the grooves on the cylindrical body being triangular in longitudinal cross-section;

an intermediate element carried by the cylindrical body, the intermediate element having an inner side containing a plurality of inner grooves having the same configuration in longitudinal cross-section as the grooves of the cylindrical body and for interacting with the grooves of the cylindrical body, each of the inner grooves having an upward facing flank and a downward facing flank;

the intermediate element having an outer side having conical upward facing and downward facing bearing surfaces capable of bearing on the downward facing and upward facing bearing surfaces, respectively, of the outer support, the upward facing and downward facing bearing surfaces of the intermediate element inclining at angles relative to said longitudinal axis;

means for elastically urging the intermediate element to a position in which the inner grooves engage the grooves of the cylindrical body;

the downward facing flanks of the inner grooves being located at an angle relative to said longitudinal axis that is less than the angle, relative to said longitudinal axis, of the upward facing bearing surface of the intermediate element; and the upward facing flanks of the inner grooves being located at the same angle relative to said longitudinal axis of the cylindrical body as the downward facing flanks of the inner grooves, said angle of the upward facing flanks being greater than the angle, relative to said longitudinal axis, of the downward facing bearing surface of the intermediate element;

so that when the cylindrical body is subjected to an upward force, a radial component of a resultant of said force is directed outward from said longitudinal axis, and when the cylindrical body is subjected to a downward force, a radial component of a resultant of said force is directed inward toward said longitudinal axis.

3. A device for supporting a cylindrical body in a stationary tubular outer support, the cylindrical body having a longitudinal axis, the device comprising in combination:

at least one recess located in the outer support, having a conical downward facing bearing surface and a conical upward facing bearing surface;

a plurality of circumferential grooves located on the exterior of the cylindrical body, each of the grooves on the cylindrical body being triangular in longitudinal cross-section;

an intermediate element comprising a split ring carried by the cylindrical body, the intermediate element having an inner side containing a plurality of inner grooves having the same configuration in longitudinal cross-section as the grooves of the cylindrical body and for interacting with the grooves of the cylindrical body, each of the inner grooves having an upward facing flank and a downward facing flank;

the intermediate element being elastically expansible from a position wherein the inner grooves engage the grooves of the cylindrical body;

the intermediate element having an outer side having conical upward facing and downward facing bearing surfaces capable of bearing on the downward facing and upward facing bearing surfaces of the outer support, respectively, the upward facing and downward facing bearing surfaces of the intermediate element being located at angles relative to said longitudinal axis;

the downward facing flanks of the inner grooves being located at an angle relative to said longitudinal axis that is less than the angle, relative to said longitudinal axis, of the upward facing bearing surface of the intermediate element; and the upward facing flanks of the inner grooves being located at an angle relative to said longitudinal axis that is greater than the angle, relative to said longitudinal axis, of the downward facing bearing surface of the intermediate element, so that when the cylindrical body is subjected to an upward force, a radial component of a resultant of said force is directed outward from said longitudinal axis, and when the cylindrical body is subjected to a downward force, a radial component of a resultant of said force is directed inward toward said longitudinal axis.

4. A device for supporting a cylindrical body in a stationary tubular outer support, the cylindrical body having a longitudinal axis, the device comprising in combination:

at least one recess located in the outer support, having a conical downward facing bearing surface and a conical upward facing bearing surface;

an annular receptacle formed on the exterior of the cylindrical body;

a plurality of circumferential grooves located on the exterior of the cylindrical body below the receptacle, each of the grooves on the cylindrical body being triangular in longitudinal cross-section;

an intermediate element comprising a split ring initially carried in the annular receptacle by the cylindrical body, the intermediate element having an inner side containing a plurality of inner grooves having the same configuration in longitudinal cross-section as the grooves of the cylindrical body and for interacting with the grooves of the cylindrical body, each of the inner grooves having an upward facing flank and a downward facing flank;

the intermediate element being elastically expansible and having an inner diameter of the inner grooves when neither contracted nor expanded that is no greater than the outer diameter of the grooves on the cylindrical body;

the intermediate element having an outer side having conical upward facing and downward facing bearing surfaces capable of bearing on the downward facing and upward facing bearing surfaces of the outer support, respectively, the upward facing and downward facing bearing surfaces of the intermediate element being located at angles relative to said longitudinal axis;

the downward facing flanks of the inner grooves being located at an angle relative to said longitudinal axis that is less than the angle, relative to said longitudinal axis, of the upward facing bearing surface of the intermediate element; and the upward facing flanks of the inner grooves being located at an angle relative to said longitudinal axis that is greater than the angle, relative to said longitudinal axis, of the downward facing bearing surface of the intermediate element;

the upward facing bearing surface of the outer support being positioned so as to be landed on by the downward facing bearing surface of the intermediate element while it is located in the receptacle of the cylindrical body;

the angle of the upward facing bearing surface of the outer support causing the intermediate element to expand outward into the recess of the outer support upon downward force on the cylindrical body;

the difference in the angles of the downward facing flanks of the inner grooves of the intermediate element and the upward facing bearing surface of the intermediate element resulting in an outward radial force component on the intermediate element upon application of an upward force on the cylindrical body, allowing the cylindrical body to be moved upward relative to the intermediate element after the intermediate element has landed on the upward facing bearing surface of the outer support, to position the grooves on the cylindrical body adjacent the inner grooves on the intermediate element, with the inner grooves ratcheting past the grooves on the cylindrical body during said upward movement; and the difference in the angles of the upward facing flanks of the inner grooves and the downward facing bearing surface of the intermediate element resulting in an inward radial force component on the intermediate element upon application of a downward force on the cylindrical body to support the cylindrical body on the outer support.

5. A device for supporting a cylindrical body in a stationary tubular outer support, the cylindrical body having a longitudinal axis, the device comprising in combination:

at least one recess located in the outer support, having a conical downward facing bearing surface and a conical upward facing bearing surface;

a flange extending radially from the exterior of the cylindrical body;

an annular receptacle formed on the exterior of the cylindrical body directly below the flange;

a plurality of circumferential grooves located on the exterior of the cylindrical body below the receptacle, each of the grooves on the cylindrical body being triangular in longitudinal cross-section;

an intermediate element comprising a split ring initially carried in the annular receptacle by the cylindrical body, the intermediate element having an inner side containing a plurality of inner grooves having the same configuration in longitudinal cross-section as the grooves of the cylindrical body and for interacting with the grooves of the cylindrical body, each of the inner grooves having an upward facing flank and a downward facing flank;

the intermediate element being elastically expansible and having an inner diameter of the inner grooves when neither expanded nor contracted that is no greater than the outer diameter of the grooves on the cylindrical body;

the intermediate element having an outer side having conical upward facing and downward facing bearing surfaces capable of bearing on the downward facing and upward facing bearing surfaces of the outer support, respectively, the upward facing and downward facing bearing surfaces of the intermediate element being located at angles relative to said longitudinal axis;

the downward facing flanks of the inner grooves being located at an angle relative to said longitudinal axis that is less than the angle, relative to said longitudinal axis, of the upward facing bearing surface of the intermediate element; and the upward facing flanks of the inner grooves being located at an angle relative to said longitudinal axis that is greater than the angle, relative to said longitudinal axis, of the downward facing bearing surface of the intermediate element;

the upward facing bearing surface of the outer support being positioned so as to be landed on by the downward facing bearing surface of the intermediate element while it is located on the receptacle of the cylindrical body;

the angle of the upward facing bearing surface of the outer support causing the intermediate element to expand outward into the recess of the outer support upon downward force on the cylindrical body;

shear means, comprising a pin extending through an elongated slot in the flange and connected to the intermediate element, for retaining the intermediate element in the receptacle until a sufficient tensile force is applied, for allowing the intermediate element to expand without shearing the shear pin upon landing on the upward facing bearing surface of the outer support, then for shearing the pin to allow upward movement of the cylindrical member relative to the intermediate element;

the difference in the angles of the downward facing flanks of the inner grooves of the intermediate element and the upward facing bearing surface of the intermediate element resulting in an outward radial force component of the intermediate element upon application of an upward force on the cylindrical body, allowing the cylindrical body to be moved upward relative to the intermediate element after the intermediate element has landed on the upward facing bearing surface of the outer support and the shear pin has sheared, to position the grooves on the cylindrical body adjacent the inner grooves on the intermediate element, with the inner grooves ratcheting past the grooves on the cylindrical body during said upward movement; and the difference in the angles of the upward facing flanks of the inner grooves and the downward facing bearing surface of the intermediate element resulting in an inward radial force component on the intermediate element upon application of a downward force on the cylindrical body to support the cylindrical body on the outer support.

6. A device for supporting a cylindrical body in a stationary tubular outer support, the cylindrical body having a longitudinal axis, the device comprising in combination:

a pair of vertically spaced recesses located in the outer support, each having a conical downward facing bearing surface and a conical upward facing bearing surface;

a flange extending radially from the exterior of the cylindrical body;

an annular receptacle formed on the exterior of the cylindrical body directly below the flange;

a plurality of circumferential grooves located in the exterior of the cylindrical body below the receptacle, each of t he grooves on the cylindrical body being triangular in longitudinal cross-section, defining a V-shaped bottom;

an intermediate element comprising a split ring initially carried in the annular receptacle by the cylindrical body, the intermediate element having an inner side containing a plurality of inner grooves having the same configuration in longitudinal cross-section as the grooves of the cylindrical body and for interacting with the grooves of the cylindrical body, each of the inner grooves having an upward facing flank and a downward facing flank, intersecting at a V-shaped apex, the inner side having an annular slot;

the intermediate element being elastically expansible and having an inner diameter when neither contracted nor expanded of the inner grooves that is no greater than the outer diameter of the grooves on the cylindrical body;

a partition extending outward from outward from the receptacle, dividing the receptacle into two compartments, the partition having a circular outer diameter, the partition initially receiving the slot of the intermediate element, the outer diameter of the partition being equal to the diameter of the inner grooves of the intermediate element measured at the apex, the outer diameter of the partition being equal to the diameter of the grooves of the cylindrical body measured at the bottom;

the intermediate element having an outer side having a pair of vertically spaced apart conical upward facing and downward facing bearing surfaces, each capable of bearing on the downward facing and upward facing bearing surfaces of the outer support, respectively, the upward facing and downward facing bearing surfaces of the intermediate element being located at angles relative to said longitudinal axis;

the downward facing flanks of the inner grooves being located at an angle relative to said longitudinal axis that is less than the angle, relative to said longitudinal axis, of the upward facing bearing surface of the intermediate element; and the upward facing flanks of the inner grooves being located at an angle relative to said longitudinal axis that is greater than the angle, relative to said longitudinal axis, of the downward facing bearing surface of the intermediate element;

the upward facing bearing surface of the outer support being positioned so as to be landed on by the downward facing bearing surface of the intermediate element while it is located on the receptacle of the cylindrical body;

the angle of the upward facing bearing surface of the outer support causing the intermediate element to expand outward into the recess of the outer support upon downward force on the cylindrical body;

shear means, comprising a pin extending through an elongated slot in the flange and connected to the intermediate element, for retaining the intermediate element in the receptacle until a sufficient tensile force is applied, for allowing the intermediate element to expand without shearing the shear pin upon landing on the upward facing bearing surface of the outer support, then for shearing the pin to allow upward movement of the cylindrical member relative to the intermediate element;

the difference in the angles of the downward facing flanks of the inner grooves of the intermediate element and the upward facing bearing surface of the intermediate element resulting in an outward radial force component on the intermediate element upon application of an upward force on the cylindrical body, allowing the cylindrical body to be moved upward relative to the intermediate element after the intermediate element has landed on the upward facing bearing surface of the outer support and the shear pin has sheared, to position the grooves on the cylindrical body adjacent the inner grooves on the intermediate element, with the inner grooves ratcheting past the grooves on the cylindrical body during said upward movement and the partition contacting the grooves of the intermediate element to prevent retraction of the intermediate element; and the difference in the angles of the upward facing flanks of the inner grooves and the downward facing bearing surface of the intermediate element resulting in an inward radial force component on the intermediate element upon application of a downward force on the cylindrical body to support the cylindrical body on the outer support.

* * * * *